US009139976B2

(12) United States Patent
Goldspink

(10) Patent No.: US 9,139,976 B2
(45) Date of Patent: Sep. 22, 2015

(54) DUCKBILL EJECTOR

(75) Inventor: Robert John Goldspink, Kandos (AU)

(73) Assignee: R.J. Goldspink PTY Limited, Kandos (AU)

( * ) Notice: Subject to any disclaimer, the term of this patent is extended or adjusted under 35 U.S.C. 154(b) by 0 days.

(21) Appl. No.: 14/241,474

(22) PCT Filed: Aug. 24, 2012

(86) PCT No.: PCT/AU2012/001018

§ 371 (c)(1),
(2), (4) Date: Feb. 27, 2014

(87) PCT Pub. No.: WO2013/029103

PCT Pub. Date: Mar. 7, 2013

(65) Prior Publication Data

US 2014/0234063 A1 Aug. 21, 2014

(30) Foreign Application Priority Data

Sep. 2, 2011 (AU) ..... 2011903545

(51) Int. Cl.
*E02F 3/407* (2006.01)
*B66F 9/19* (2006.01)
*E02F 3/96* (2006.01)

(52) U.S. Cl.
CPC ..... *E02F 3/407* (2013.01); *B66F 9/195* (2013.01); *E02F 3/96* (2013.01)

(58) Field of Classification Search
CPC ..... E02F 3/407; B66F 9/195
USPC ..... 414/488, 489, 497, 661, 662, 668, 725
See application file for complete search history.

(56) References Cited

U.S. PATENT DOCUMENTS

| | | | | |
|---|---|---|---|---|
| 2,973,878 | A * | 3/1961 | Gibson | 414/664 |
| 3,486,642 | A * | 12/1969 | Plefka et al. | 198/748 |
| 3,777,915 | A | 12/1973 | Reed | |
| 3,788,507 | A | 1/1974 | Voss | |
| 3,937,345 | A | 2/1976 | Countryman | |
| 4,309,141 | A * | 1/1982 | Van Drie | 414/509 |
| 5,466,112 | A * | 11/1995 | Feller | 414/528 |
| 5,603,382 | A | 2/1997 | Mciver | |
| 2007/0243053 | A1 * | 10/2007 | Babiarz | 414/725 |

* cited by examiner

*Primary Examiner* — Scott Lowe
(74) *Attorney, Agent, or Firm* — Fraser Clemens Martin & Miller LLC; William J. Clemens

(57) ABSTRACT

A duckbill pod (100) having an ejector mechanism, the duckbill pod (100) comprising a tray (10) for providing a transport surface for goods or material, a pusher plate (50) arranged substantially perpendicular to the tray (10), a drive arrangement for actuating the pusher plate (50) and reciprocate same between a mouth and a rear end of the duckbill pod (100), and a lifting plate (20) secured to the tray (10) for attaching the duckbill pod (100) to a loader.

10 Claims, 14 Drawing Sheets

DUCKBILL EJECTOR

FIELD OF THE INVENTION

The present invention relates to duckbill pods, also referred to as duckbills or ducksbills, of the type used with loaders, most typically on mining sites as a general purpose carrying device in conjunction with load-haul-dump (LHD) loaders.

BACKGROUND OF THE INVENTION

There exist a multitude of accessories for loaders, bulldozers and the like that fulfil various purposes. A variety of simple buckets, scoops and so on are used in various contexts for moving materials, such as dirt, gravel and the like.

The mining industry in particular has developed a broad range of specialised loader accessories that are used above and below ground as required. These accessories are adapted for tasks required underground, which include not only lifting and transport of raw materials, but also transport and storage of equipment.

Due to the challenges of working underground, especially on low seam heights, low profile wheel loaders are favoured and built to purpose. As an example, the Eimco brand of wheel loaders is widely used in Australia and elsewhere.

Duckbills are one of the various fabricated loader accessories available, and are favoured for transport of general purpose goods. A duckbill generally consists of a tray of relatively extensive dimensions (for example, 2.5 m by 2.5 m), side walls, and a back wall in the form of a lifting plate, fitted with QDS (Quick Detach System) or RAS fixtures for fitting the duckbill to a loader. The loader arms or horns engage with the QDS or similar fixtures formed on the lifting plate to removably secure the duckbill to the loader.

Duckbills have proved useful in general service and their use has been favoured in many contexts beyond which their original design was envisaged.

There accordingly exists a need for improvements to duckbills that at least attempt to improve their utility for certain tasks, or at least provide a useful alternative to existing constructions.

SUMMARY OF THE INVENTION

The inventive concept resides in a duckbill ejector, namely a duckbill pod having an ejector mechanism, the duckbill pod comprising a tray for providing a transport surface for goods or material, a pusher plate arranged substantially perpendicular to the tray, a drive arrangement for actuating the pusher plate and reciprocate same between a mouth and a rear end of the duckbill pod, and a lifting plate secured to the tray for attaching the duckbill pod to a loader.

The drive arrangement can be selectively actuated to drive the pusher plate along the tray, thereby to eject goods or materials from the duckbill pod or draw such goods into the duckbill pod.

The drive arrangement is preferably chain-driven and hydraulically-actuated, and features an hydraulic motor which engages dual driving sprockets, which drive dual chains. The dual chains in turn drive idler sprockets mounted on a pusher housing, to which the pusher plate is secured. The pusher housing slidingly engages adjacent parallel rods that pass through the pusher housing and which in effect align and direct the pusher plate across the tray via the pusher housing.

Further features of the invention are become apparent from the following description of preferred embodiments.

DESCRIPTION OF PREFERRED EMBODIMENTS

Figure 1:
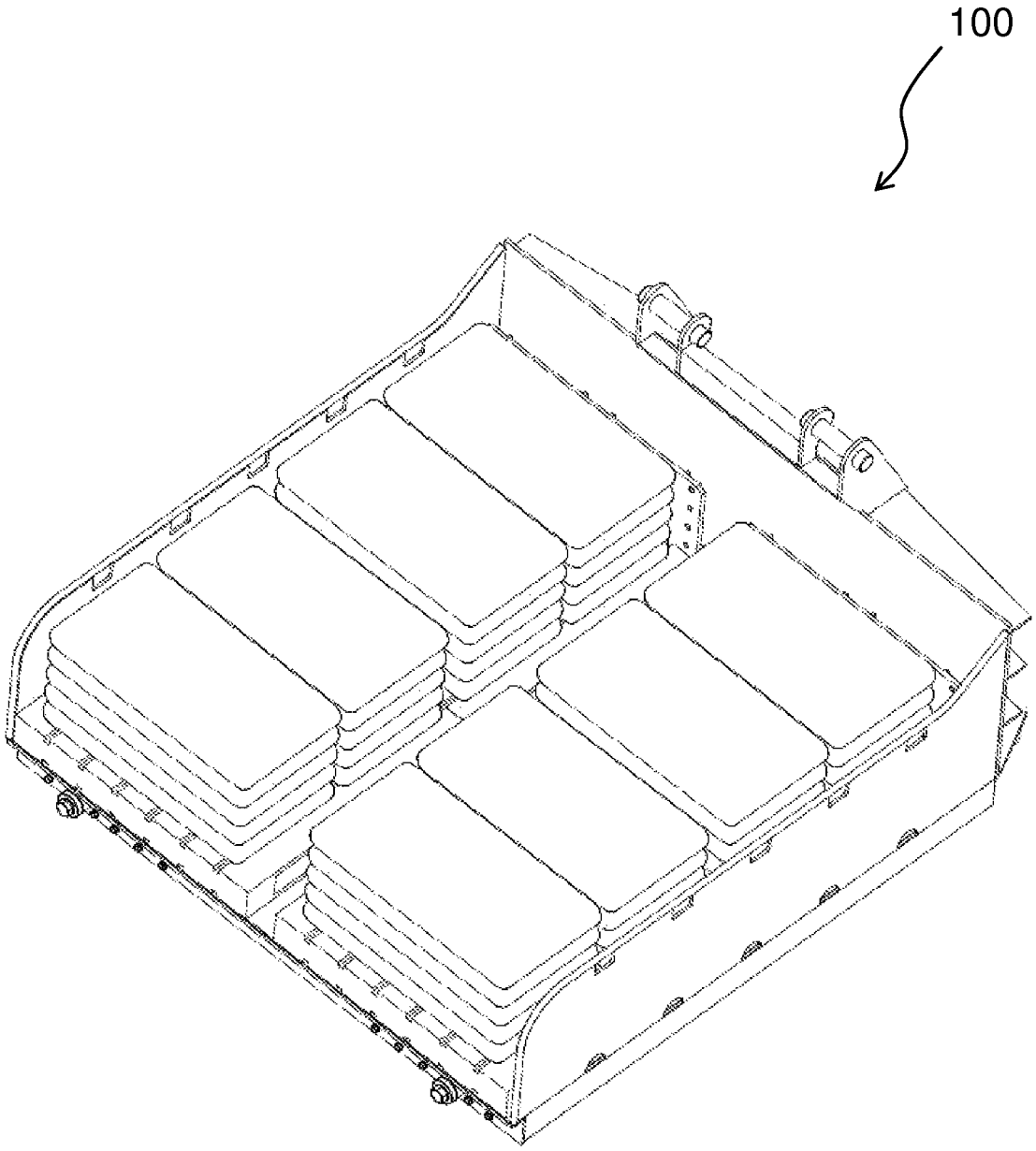
FIG. 1 is a perspective drawing of a duckbill in accordance with a preferred embodiment of the present invention from above, loaded with stacked pallets.

FIGS. 1 to 4 illustrate in perspective view from various angles a duckbill having an ejector mechanism, referred to herein as a duckbill ejector 100. The duckbill ejector 100 has a tray 10, which is bounded on three sides by a lifting plate 20 and sidewalls 30.

The tray 10 is rectangular in extent, and is approximately square is shape, and provides a surface for general purpose use, which may typically include resting, storing or transporting any suitable goods or materials. The duckbill ejector 100 is intended for general use on mining sites, above and below ground, for moving goods and material.

The lifting plate 20 is fixed securely along one side or edge of the tray 10, referred to as the rear edge, with adjacent side edges of the tray 10 having the side walls 30 extending upwardly from the tray 10. The side walls 30 are fixed securely to the tray 10 and lifting plate 20, but in other embodiments may be removably secured to the tray 10, or completely absent.

The duckbill ejector 100 as described is rectangular in extent, and the tray 10 has bounded dimensions inside the lifting plate 20 and sidewalls 30 which are approximately 2.5 m by 2.5 m. These dimensions are sufficient to accommodate four standard-sized pallets laid in a 2×2 arrangement, as illustrated in FIG. 1. The pallets, as illustrated in FIG. 1, each carry two stacks of goods or material.

The duckbill ejector 100 is engineered to carry approximately 5000 kg, owing the structural strength of the tray 10, and lifting plate 20. The duckbill ejector is fabricated using grade 350 steel plates of suitable dimension, and joined using suitable structural welding techniques. While goods or materials can be carried within weight and volume limitations, stacked pallets are a typical payload. The tray 10 of the duckbill ejector 100 may in alternative embodiments be provided with an optional divider which can be removably positioned between the pusher plates 50, running the length of the tray along its middle, provided to avoid adjacent pallets from catching upon each other during loading or unloading.

Figure 2:
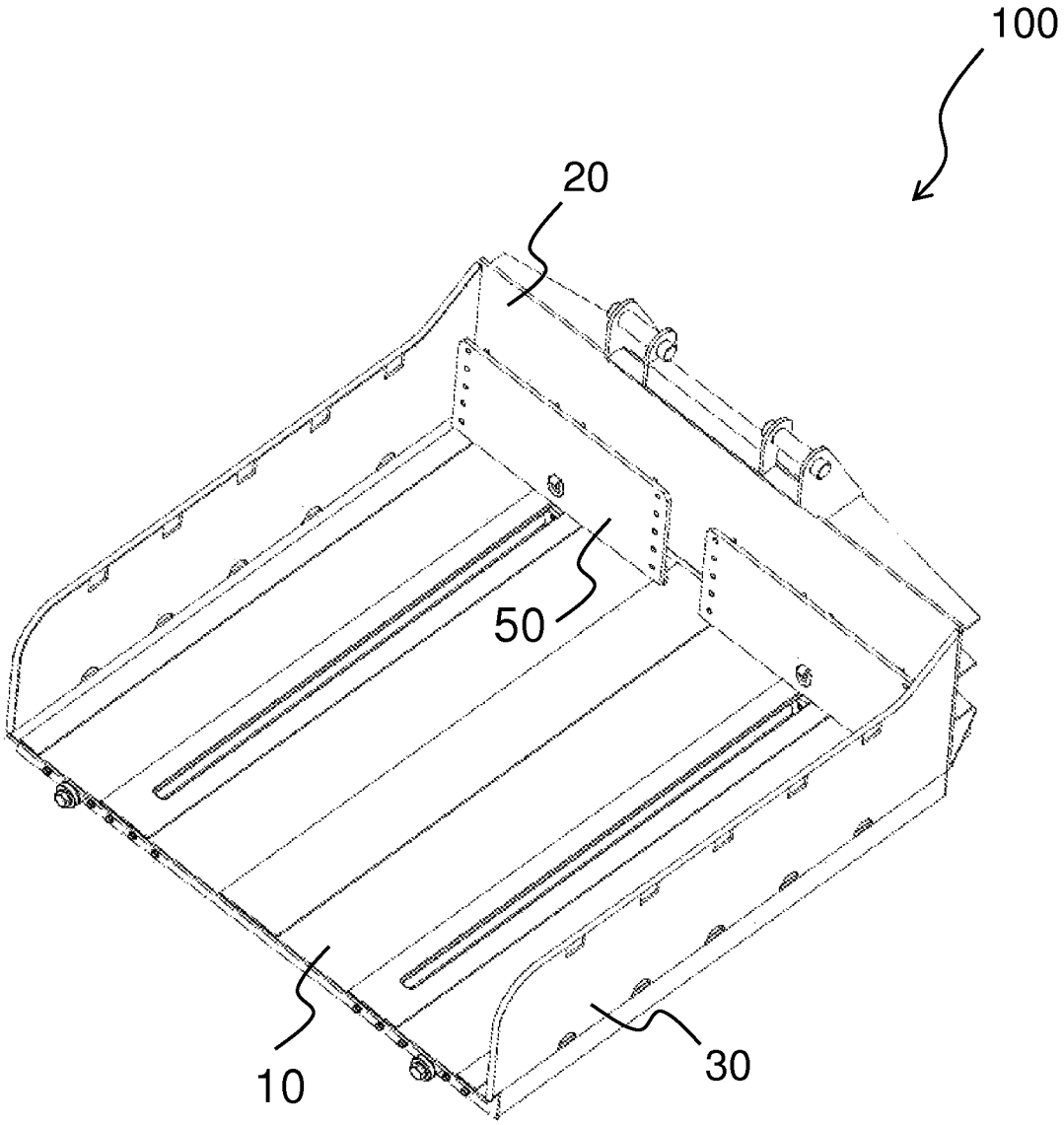
FIG. 2 is a perspective drawing of the duckbill of FIG. 1, depicted without the stacked pallets.

FIG. 2 most clearly shows pusher plates 50 arranged in their typical resting position at the rear of the tray 10, positioned adjacently and parallel to the lifting plate 20. The pusher plates 50 can be actuated selectively and independently such that they move forwards and backwards between the rear edge and front edge of the tray 10.

Figure 3:
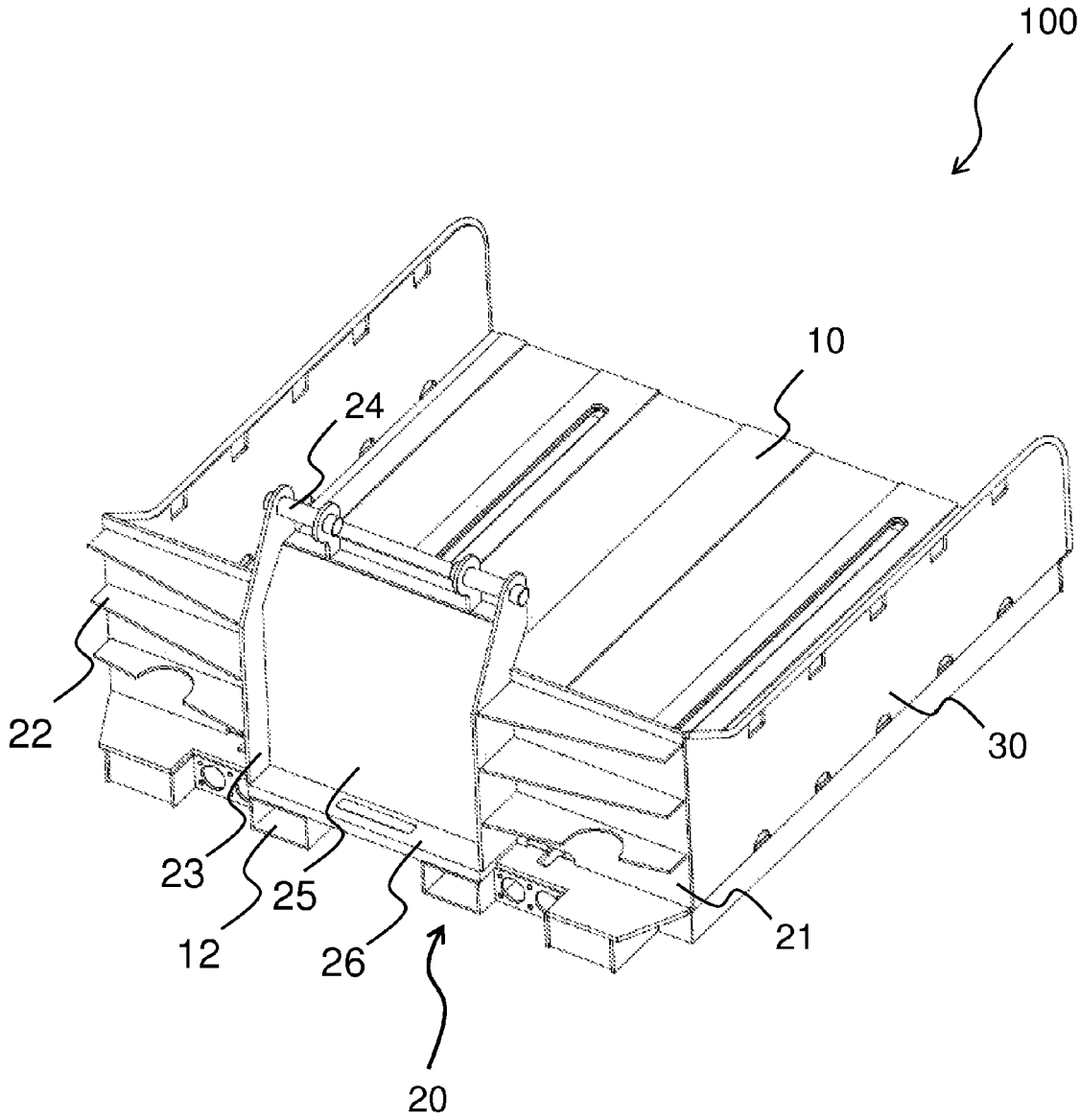
FIG. 3 is a perspective drawing of the duckbill of FIG. 1 from its rear.

FIG. 3 shows the rear of the duckbill ejector 100 and more particularly the lifting plate 20. The lifting plate 20 includes a plate 21, strengthened by ribs 22, which extend from the side edges of the lifting plate 20 to bracing plates 23, which are arranged vertically in spaced arrangement around the middle of the lifting plate 20. The bracing plates 23 define edges of the QDS. Extending between the bracing plates is a flanged pin 24, an angled plate 25 and a securing plate 26. The bracing plates 23, flanged pin 24, angled plate 25 and securing plate 26 are arranged and dimensions to allow a QDS connection with a loader equipped to allow this type of connection.

On the loader (not shown), controllable engaging arms extend under the flanged pin 24, between the flanged pin 24 and the angled plate 25, and an engaging member is hydraulically actuated into engagement with the void in the securing plate 26. The duckbill ejector 100 is thus firmly secured and can be carried by the loader using the QDS connection.

As depicted in FIG. 3, the underside of the tray 10 incorporates voids 12 for accepting lifting tines, such as forklift tines. These voids 12 are formed of square-tubed members and are oriented lengthwise along the tray 10, allowing the duckbill ejector 100 to be lifted and carried by means other than a loader.

As is apparent from FIG. 1, which shows the duckbill ejector 100 loaded with four pallets, the pallets can be selectively ejected from the duckbill ejector 100, by actuating the pusher plates 50. Driving the left pusher plate 50 halfway from the rear of the tray 10 to the front of the tray 10 will suffice to eject the front most pallet in the left side of the duckbill ejector 100. The front right pallet can be ejected in the same manner by driving the right pusher plate 50 forward. The top surface of the tray 10 is approximately 150 mm from the bottom surface of the duckbill ejector 100. Accordingly, this is the distance the pallet traverses before hitting the ground, assuming that the duckbill ejector 100 is in fact resting on the ground.

After ejecting the front pallets, the rear pallets are now positioned adjacent the front edge of the tray 10. These remaining pallets can be subsequently ejected from the tray 10 by driving the pusher plates 50 forward to push the pallets from the duckbill ejector 100. The ejected pallets are in the interim removed from where they have been unloaded, or the loader moved backwards to provide adequate clearance for ejecting the remaining pallets.

Figure 5:
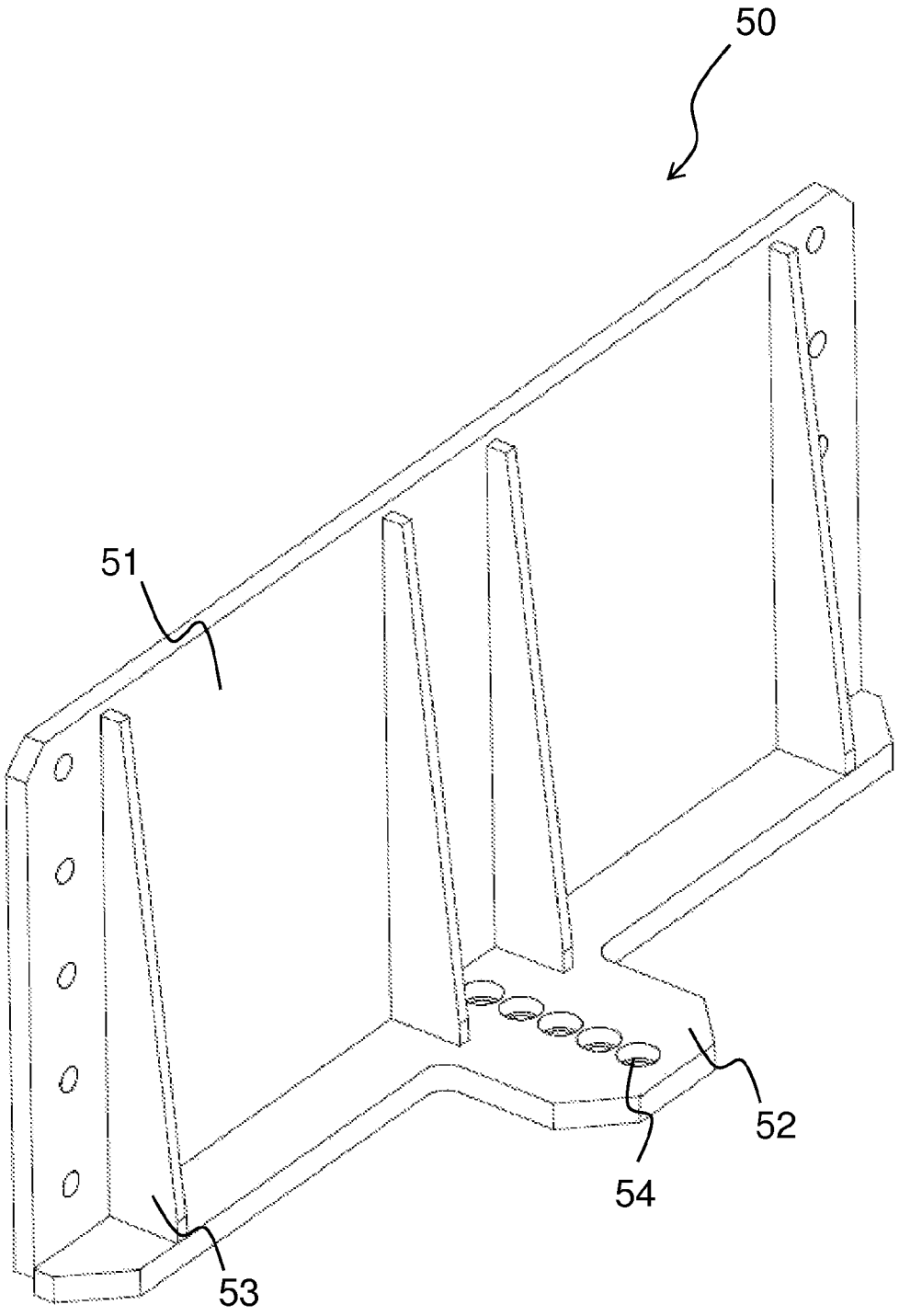
FIG. 5 is a perspective drawing of a pusher plate forming part of the duckbill of FIGS. 1 to 4.
Figure 6:
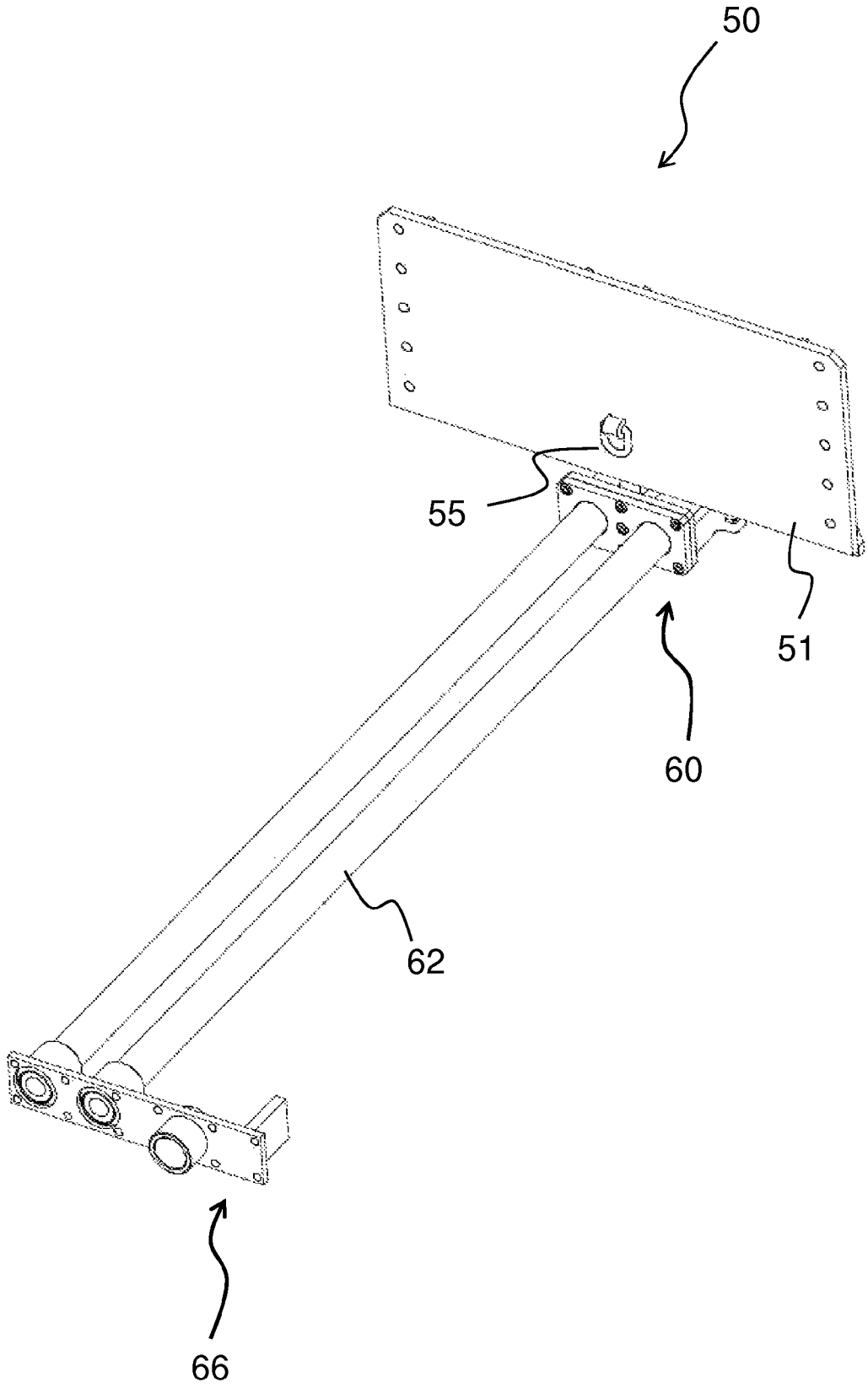
FIG. 6 is a perspective drawing of a left hand pusher plate assembly.
Figure 7:
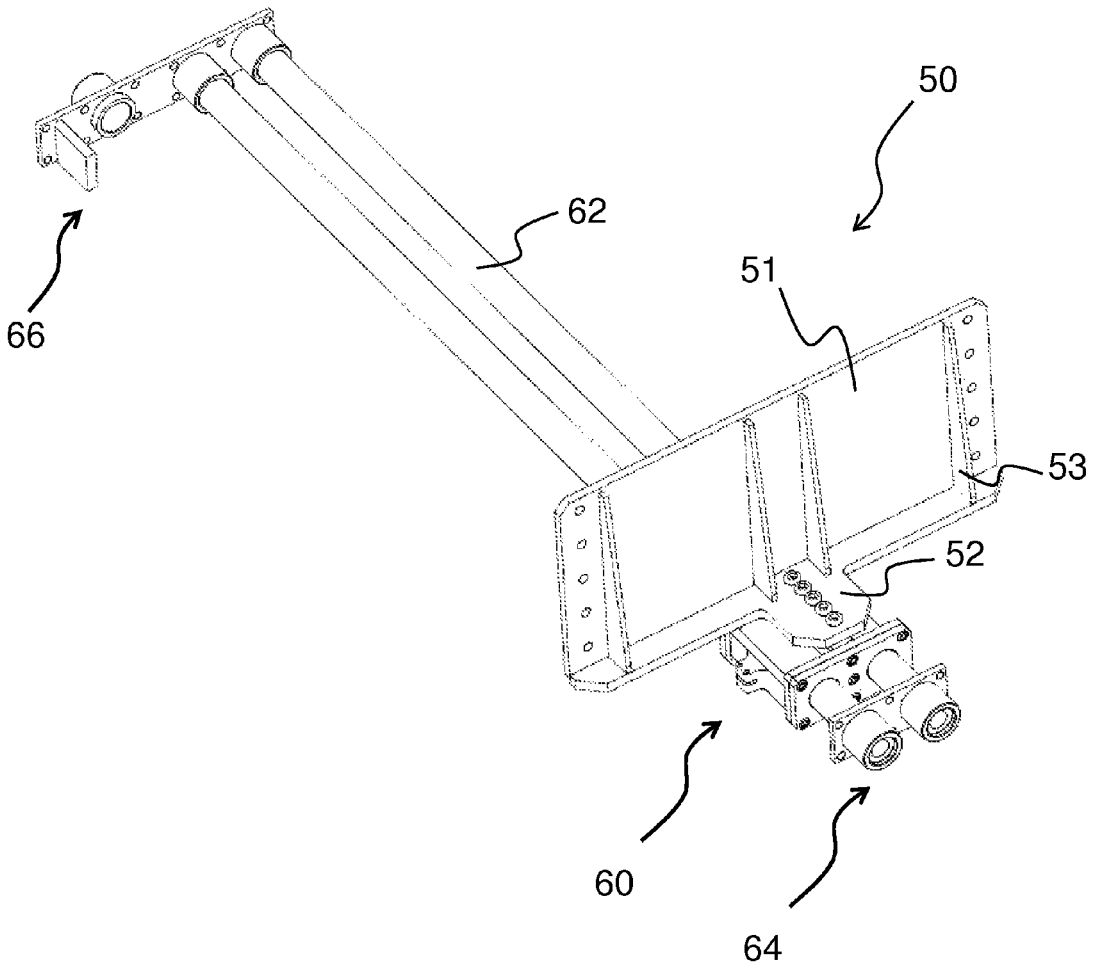
FIG. 7 is a perspective drawing of the left hand pusher plate assembly of FIG. 6, from behind.

FIG. 5 is an isolated perspective view of the pusher plate 50 which forms part of the duckbill ejector 100, and which is seen most clearly in FIG. 2 when installed on the duckbill ejector 100. The pusher plate 50 is constructed of a vertical plate 51, secured to a t-shaped plate 52 along the bottom edge of the vertical plate 51. Exposed corners of the t-shaped plate 52 are bevelled, as depicted, but may in other embodiments be rounded, for example. The structural integrity of plates 51 and 52 is supported by ribs 53 which extend vertically from the t-shaped plate 52, and taper as they extend upwardly along the surface of the vertical plate 51. The central projecting portion of the t-shaped plate 52 has boltholes 54 formed therein for securing the pusher plate 50, as described in further detail below.

Figure 8:
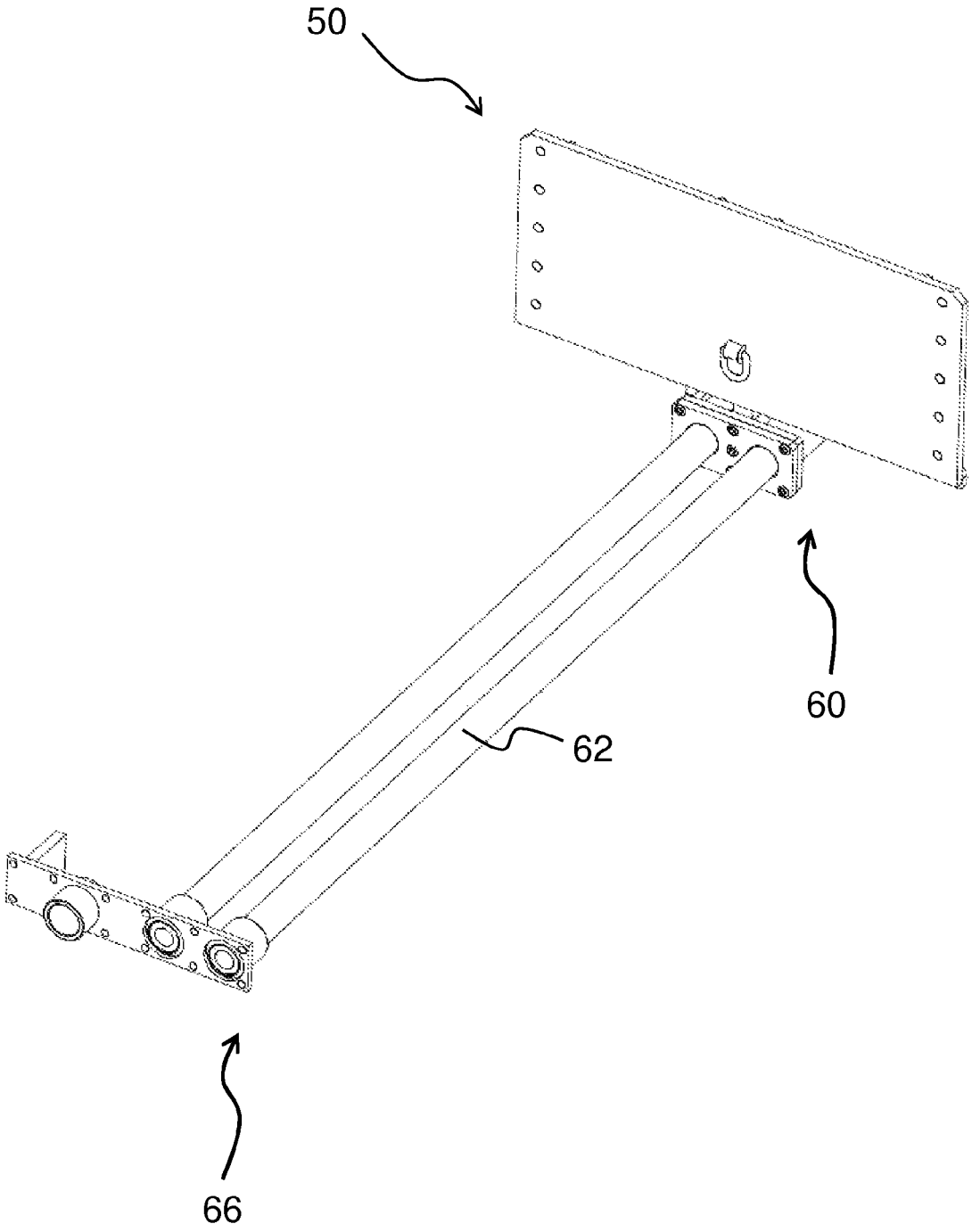
FIG. 8 is a perspective drawing of a right hand pusher plate assembly.
Figure 9:
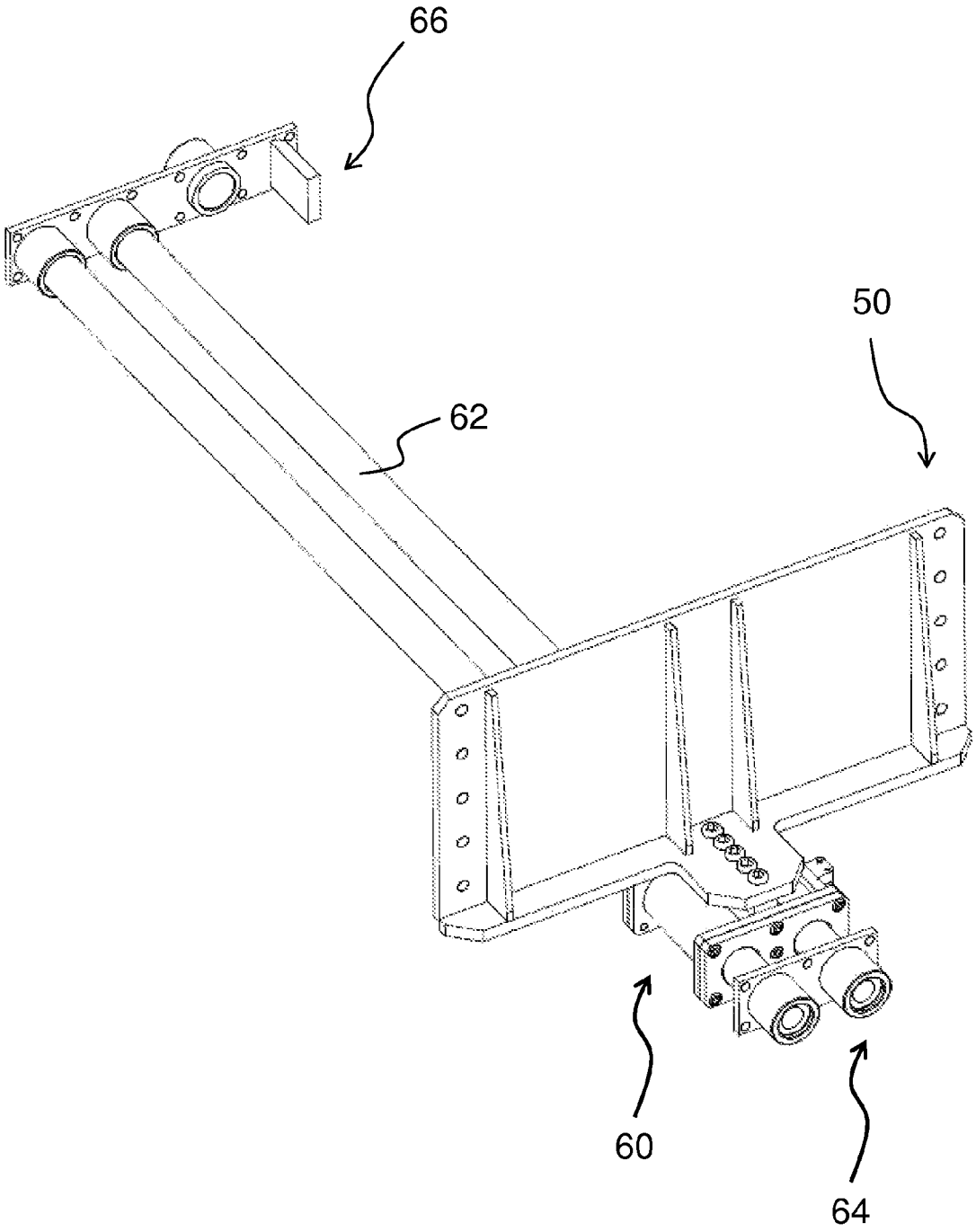
FIG. 9 is a perspective drawing of the right hand pusher plate assembly of FIG. 8 from behind.

FIGS. 6 to 9 depicted the pusher plate 50 as part of a greater assembly formed for directing movement of the pusher plate 50 across the tray 10. The assembly illustrated in FIGS. 6 to 9 is depicted for the pusher plate 50 on the left hand side of the tray 10, both from the rear and the front (FIGS. 6 and 7), and correspondingly for the right hand pusher plate 50 (FIGS. 8 and 9). The front facing surface of the vertical plate 51 of the pusher plate 50 has secured thereto a rud link 55 which can be used to pull or drag an item onto the duckbill 100, or move it deeper into the tray 10, when retracting the pusher plate 50.

The assemblies depicted both have a pusher plate 50 secured via fasteners secured in its boltholes 54 to a pusher housing 60. The pusher housing slides around rods 62, which act as rails to direct movement of the pusher plates 50. The rods 62 are terminated at their ends by a rod holder 64 located when installed towards the rear of the tray 10, and a chain tensioner bracket 66, located when installed towards the front of the tray 10. The pusher plate 50 and pusher housing 60 can slide along the rods 62, and in use are driven along the rods 62.

Figure 4:
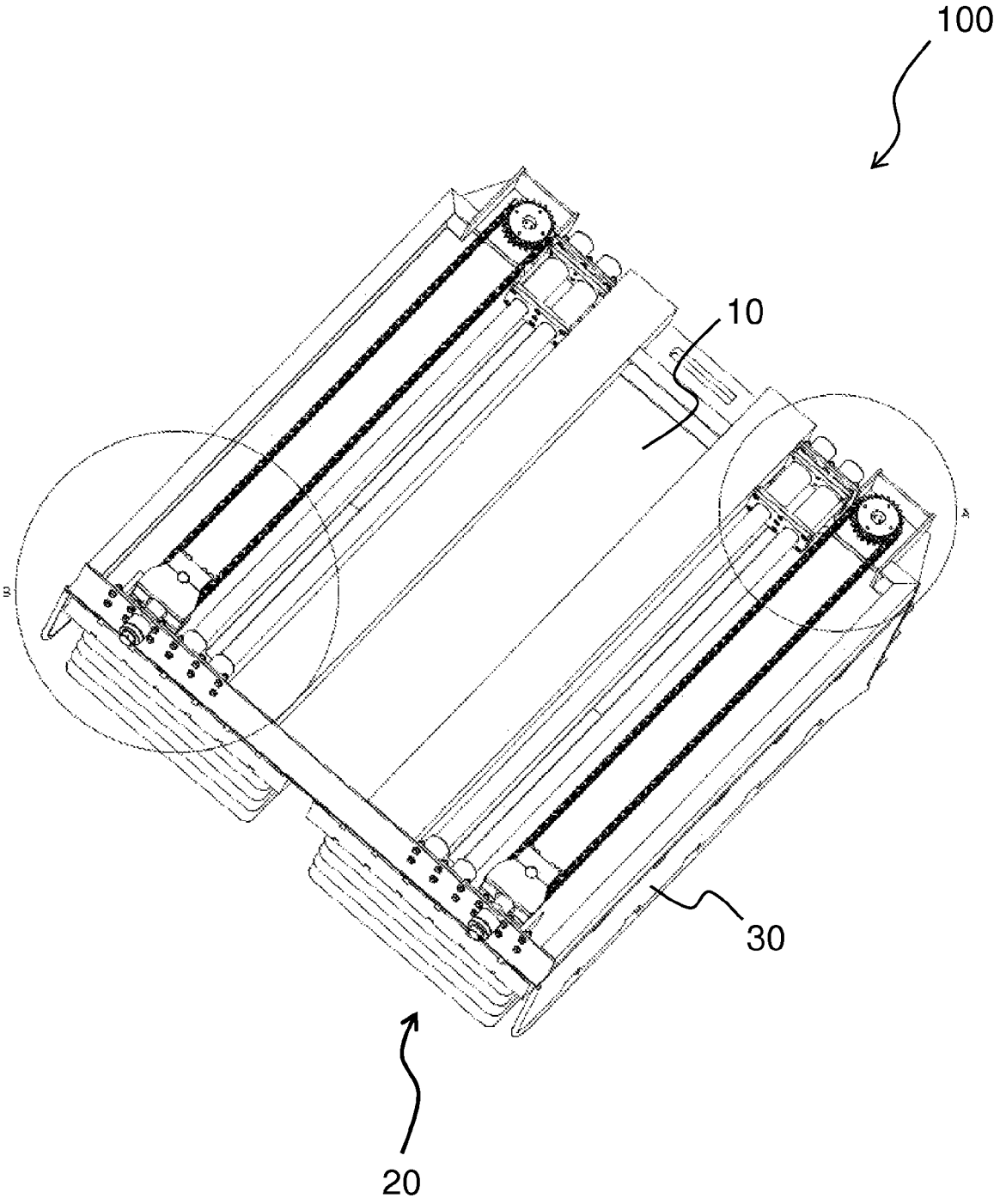
FIG. 4 is a perspective drawing of the duckbill from below, indicating details A and B.
Figure 4A:
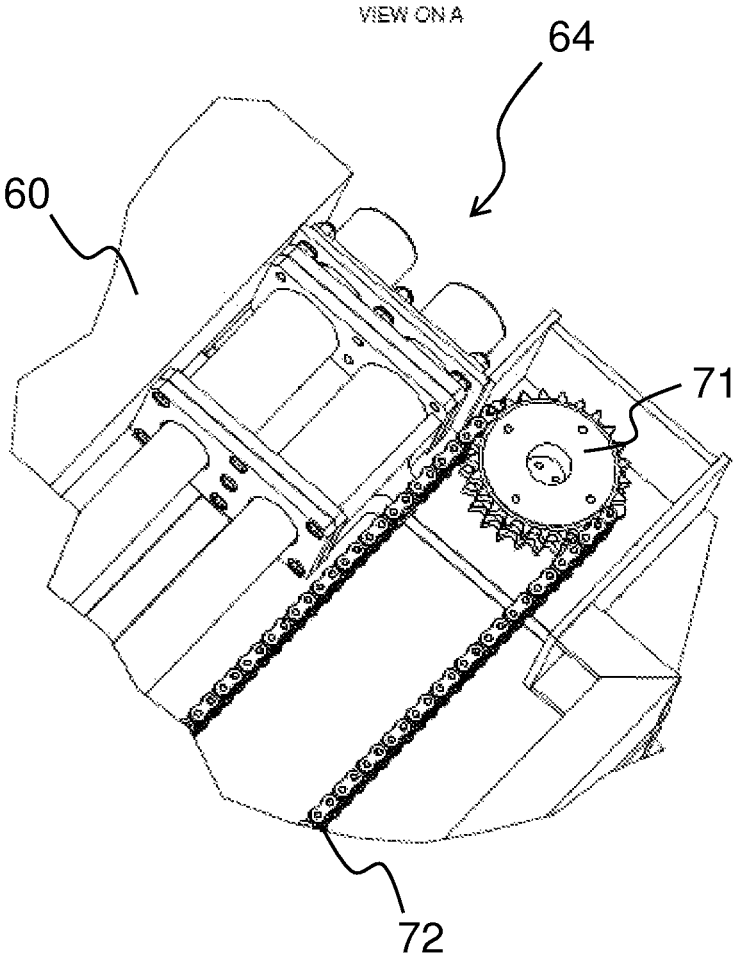
FIG. 4A is a fragmentary perspective drawing of the detail A indicated in FIG. 4.
Figure 4B:
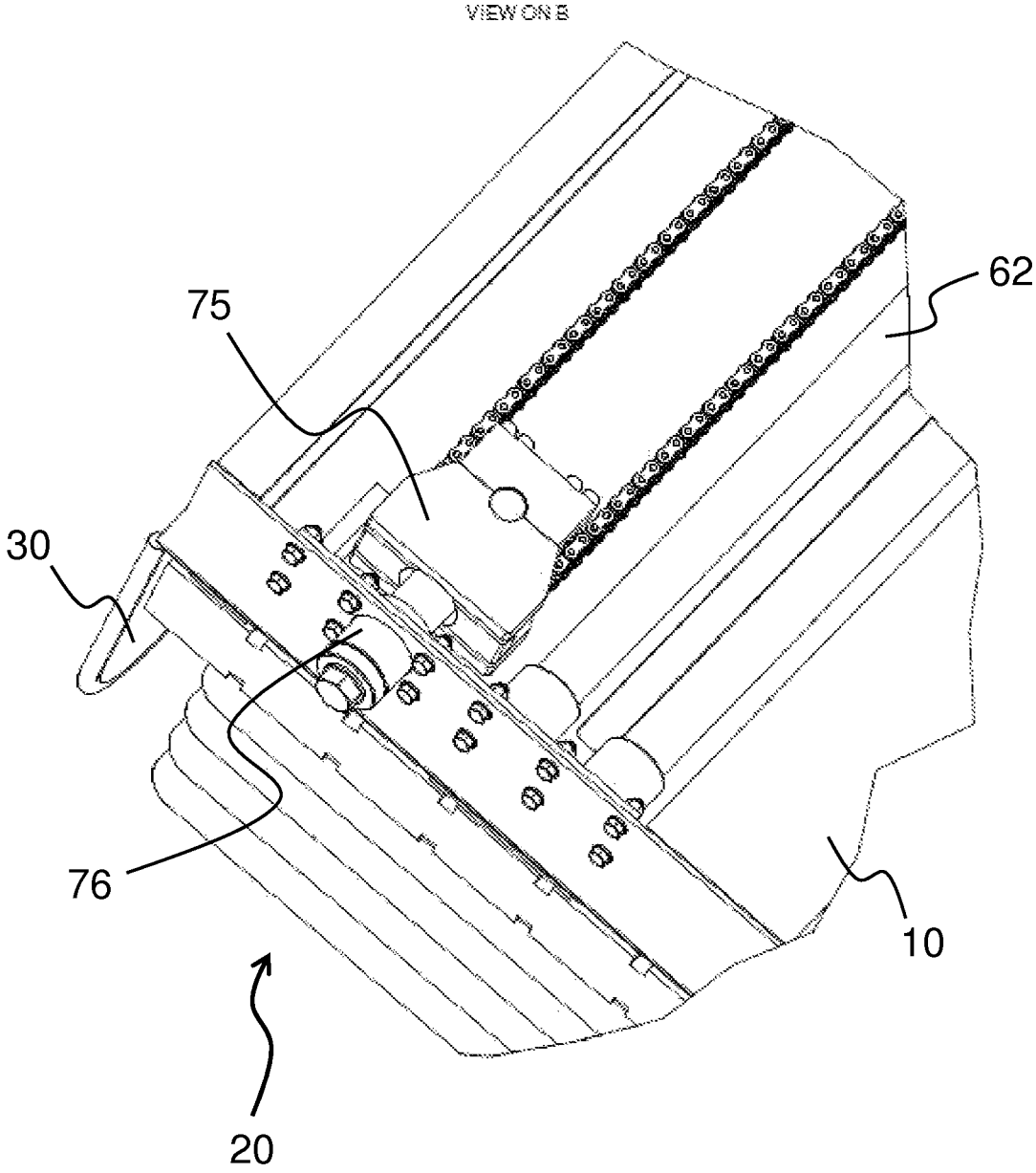
FIG. 4B is a fragmentary perspective drawing of the detail B indicated in FIG. 4.

FIGS. 4A and 4B are fragmentary details of the portions A and B indicated in FIG. 4. FIG. 4 depict elements of the driving arrangement that drives the pusher plate 50 across the tray 10 during use. As is apparent from FIG. 4, the pusher plate assembly is secured to the underside of the tray, with the rod holder 64 secured at the rear edge of the underside of the tray 10, and the chain tensioner bracket 66 secured at the front edge of the underside of the duckbill ejector 100. The tray 10 has formed therein slots that allow the pusher plate 50 to extend upwardly from the tray 10, and travel across the tray 10 in a linear trajectory defined by the rods 62.

The pusher plate 50 is driven via the pusher housing 60. Drive sprockets 71 engages dual chains 72, which act on the pusher housing 60. The chains 72 extend the length of the tray parallel and adjacent to the rods 62. The chains 72 loop around idler sprockets (not shown) located at the front edge of the tray and housed in an idler sprocket tension unit 75, which is secured at the front edge of the tray 10. The idler sprocket tension unit 75 can be adjusted to loosen or tighten the chains 72 via an adjustment bolt assembly 76, depicted adjacent the front edge of the tray 10.

Figure 10:
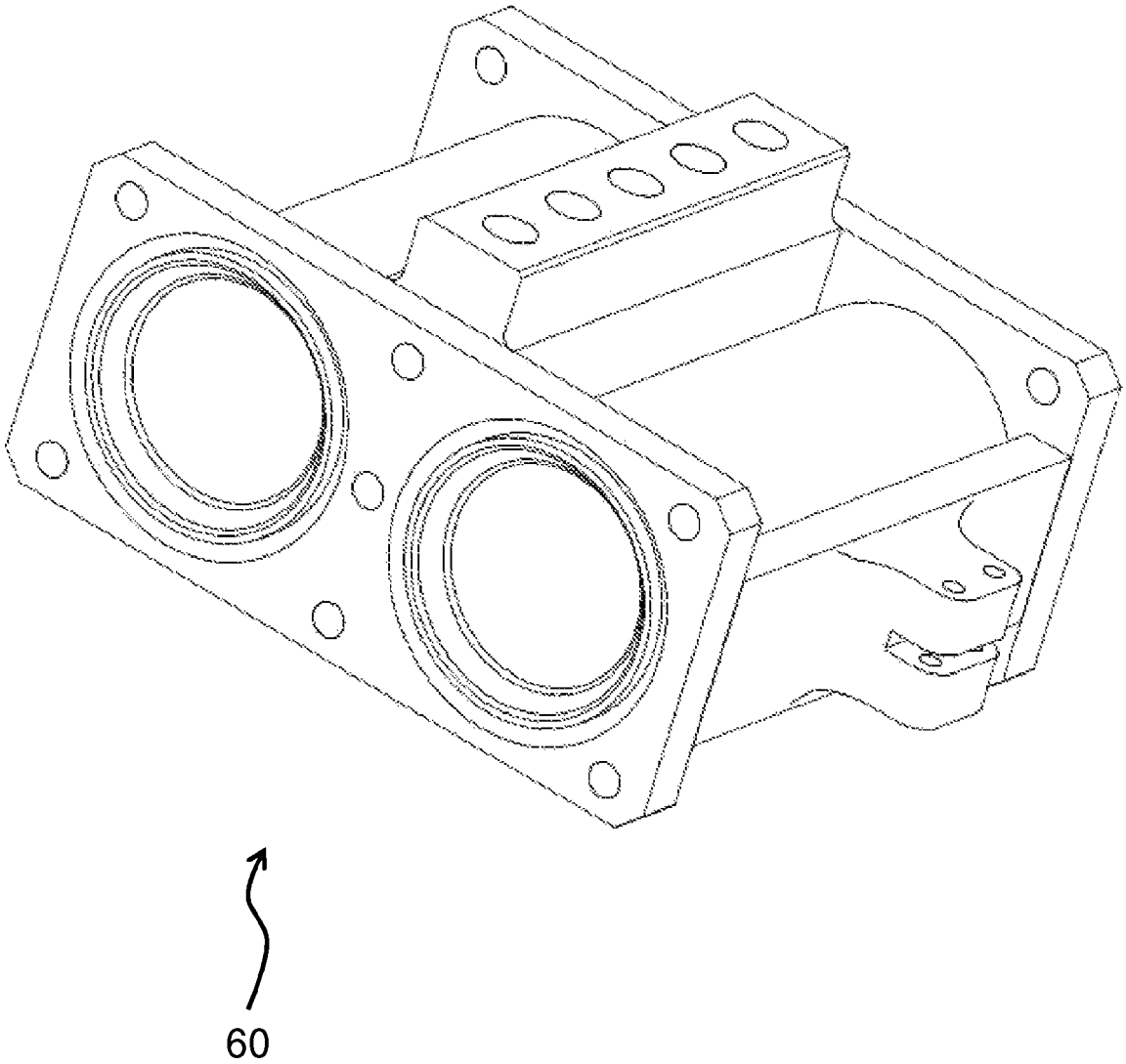
FIG. 10 is a perspective drawing of a pusher housing used in the pusher plate assembly as shown in FIGS. 6 to 9.

FIG. 10 is a perspective view of a pusher housing 60 used to secure the pusher plate 50, and slide over the rods 62.

Figure 11:
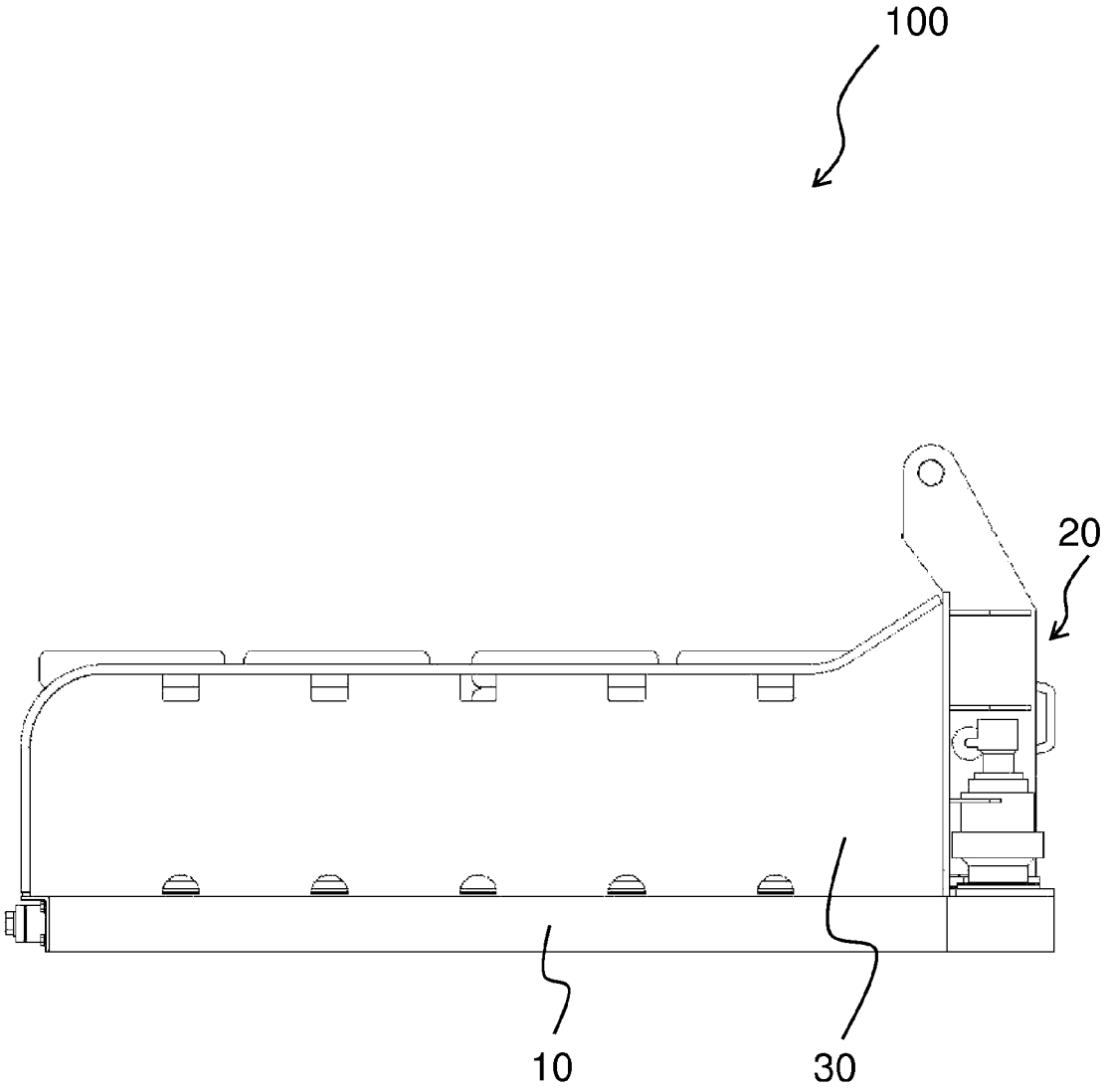
FIG. 11 is a side elevation of the duckbill of FIGS. 1 to 4.
Figure 12:
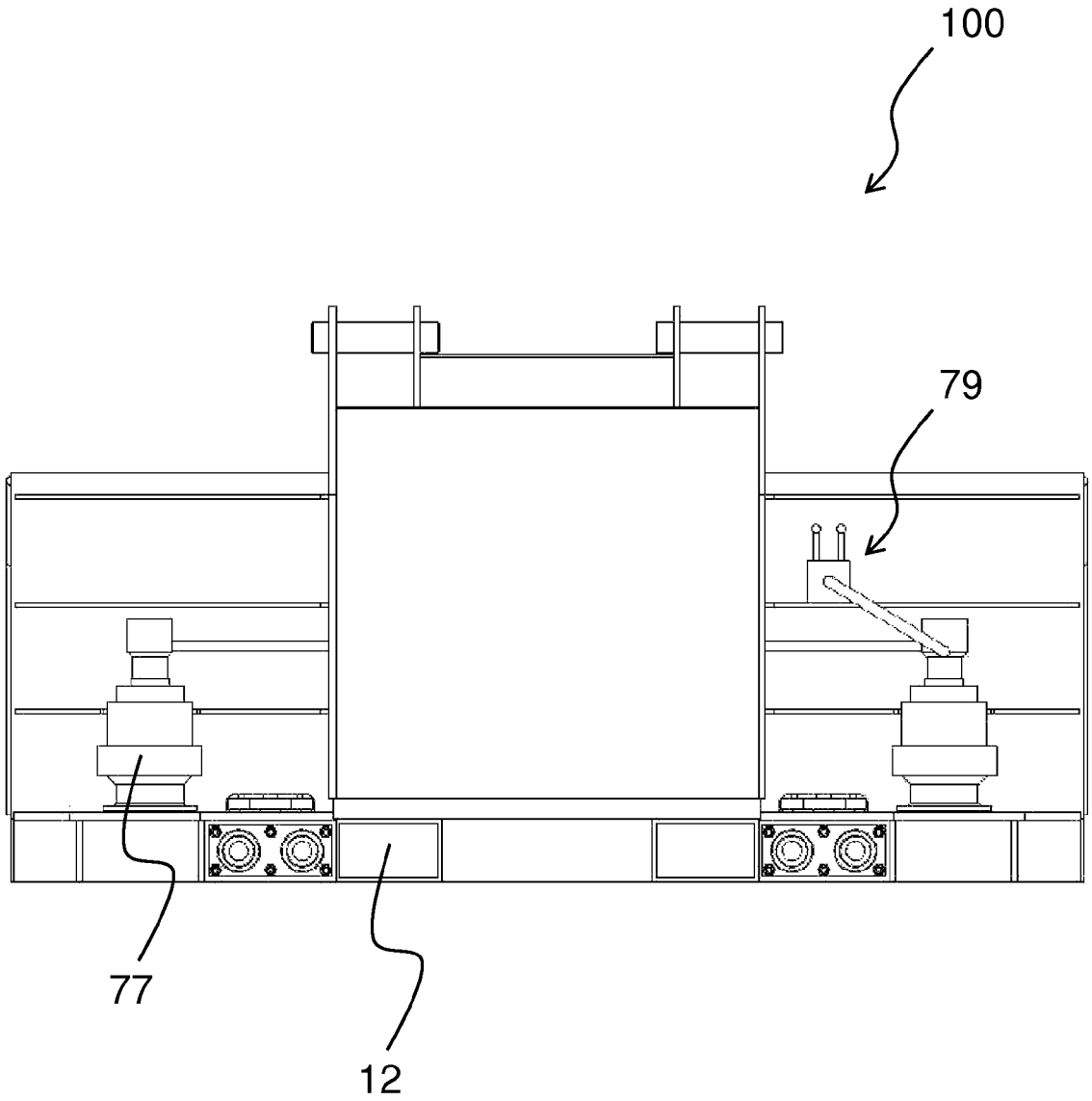
FIG. 12 is a rear elevation of the duckbill of FIGS. 1 to 4.

FIGS. 11 and 12 illustrate side and rear elevations of the duckbill ejector 100. The drive sprockets 71 are driven by drive shafts (not shown) originating in hydraulic motors 77. The motors 77 are supplied at both sides of the tray 10, located at the rear of the tray 10, and housed adjacent the lifting plate 20. The motors 77 are suitable make and model suitable for industrial use. The motors are in the preferred embodiment used in conjunction with a gearbox 5:1 to provide a suitable speed and torque output. The motors controlled via a valve bank assembly 79, which accepts a source of hydraulic pressure via input hoses, and using valve switches, directs the flow of hydraulic pressure via output hoses to the motors 77.

The abovementioned voids 12 depicted in FIG. 12 are oriented lengthwise along the tray 10, in parallel with the rods 62. This orientation differs from the typically orientation on existing duckbills, and is adopted to avoid interference with the rods 62, while minimising the height of the tray 10.

With reference to FIG. 3, the lower ribs 22 formed against the vertical plate 21 of the lifting plate has a recess formed therein to accommodate the motors 77 of either side of the QDS fixture, which are not shown in FIG. 3.

The valve bank assembly 79 can be configured to direct full pressure to either of the motors 77, or to direct the hydraulic pressure to be shared between the motors 77. The input hoses are operatively connected to a controllable source of hydraulic pressure, which is in preferred embodiments such a source originating from the loader to which the duckbill ejector 100 is attached. This is conveniently provided by a hydraulic PTO (power take off) supplied via mechanical engine power from the loader, transferred to hydraulic power by a hydraulic pump on the loader. The hydraulic power delivered to the duckbill ejector 100 can be controlled by an adjustable lever which delivers variable positive or negative pressure to the duckbill ejector 100, which consequently drives one or both of the pusher plates 50, as selected at the valve bank assembly 79.

When the duckbill ejector 100 is secured to the loader, the hoses from the loader are also connected manually to hose inlets at the valve bank assembly 79. One or both of the pusher plates 50 is selected at the duckbill ejector 100 manipulation of the valve bank assembly. The movement of the selected one or both pusher plates 50—in both push and pull directions—is thus controlled from the loader via the abovementioned lever capable of delivering variable pressure to the duckbill ejector 100. The lever may use any suitable arrangement to control the hydraulic pump, such as via cable, rod, or electronic control.

Various alternative embodiments are possible, as would be apparent to one skilled in the art. As an example, various alternative forms of drive arrangement could be used to control the pusher plates 50, such as a direct-drive hydraulic rods acting directly on the pusher housings. Also, the arrangement (and number) of pusher plates 50 used to eject or draw goods or material from or onto the duckbill ejector 100 can assume various alternative forms. As an example, side ejection may be used, in which the pusher plates 50 are oriented to move across the tray 10 from side to side rather than from rear to front.

Furthermore, an electric or hydraulically actuated winch may be secured on the duckbill ejector 100 for general purpose use, and may be used to assist loading the tray 10 when required.

The invention claimed is:

1. A duckbill pod for a loader, comprising a tray for transporting goods or material, and at least one pusher plate and a co-operating drive arrangement secured to the pusher plate for driving the pusher plate across the tray, wherein the drive arrangement is housed below the tray, the tray having a slot formed therein to permit the pusher plate to extend through the slot for the drive arrangement to drive the pusher plate, wherein the drive arrangement includes a housing fixed to the pusher plate, the housing slidingly receiving at least one rod that extends below the tray in alignment with the slot, the rod fixed with respect to the tray so that the pusher plate is guided by the housing as the housing slides on the rod.

2. The duckbill pod according to claim 1, wherein the drive arrangement comprises at least one set of co-operating idler and drive sprockets on which a chain is mounted.

3. The duckbill pod according to claim 2, wherein the drive arrangement is actuated by an external hydraulic motor driven by a controllable source of hydraulic pressure.

4. The duckbill pod according to claim 1, wherein the drive arrangement comprises at least one set of co-operating idler and drive sprockets on which a chain is mounted.

5. The duckbill pod according to claim 1, wherein the drive arrangement is actuated by an external hydraulic motor driven by a controllable source of hydraulic pressure.

6. The duckbill pod according to claim 1, further comprising side walls extending upwardly from the tray along sides of the tray.

7. The duckbill pod according to claim 1, further comprising a lifting plate positioned at one end of the tray and secured to the tray for lifting the duckbill pod.

8. The duckbill pod according to claim 1, comprising another pusher plate arranged adjacent to the at least one pusher plate and another co-operating drive arrangement secured to the another pusher plate and housed below the tray for pushing the another pusher plate across the tray, the tray having another slot formed therein to permit the another drive arrangement to drive the another pusher plate.

9. The duckbill pod according to claim 8, wherein each of the drive arrangements comprises at least one set of co-operating idler and drive sprockets on which a chain is mounted.

10. The duckbill pod according to claim 8, wherein each of the drive arrangements is actuated by an external hydraulic motor driven by a controllable source of hydraulic pressure.

* * * * *